US010563565B2

(12) United States Patent
Sato

(10) Patent No.: US 10,563,565 B2
(45) Date of Patent: Feb. 18, 2020

(54) VALVE CONTROL DEVICE

(71) Applicant: DENSO CORPORATION, Kariya, Aichi-pref. (JP)

(72) Inventor: Shingo Sato, Kariya (JP)

(73) Assignee: DENSO CORPORATION, Kariya (JP)

( * ) Notice: Subject to any disclaimer, the term of this patent is extended or adjusted under 35 U.S.C. 154(b) by 21 days.

(21) Appl. No.: 15/752,268

(22) PCT Filed: Sep. 6, 2016

(86) PCT No.: PCT/JP2016/076082

§ 371 (c)(1),
(2) Date: Feb. 13, 2018

(87) PCT Pub. No.: WO2017/068881

PCT Pub. Date: Apr. 27, 2017

(65) Prior Publication Data

US 2018/0230891 A1 Aug. 16, 2018

(30) Foreign Application Priority Data

Oct. 19, 2015 (JP) ..... 2015-205871

(51) Int. Cl.
*F01P 7/14* (2006.01)
*F01P 7/16* (2006.01)
(Continued)

(52) U.S. Cl.
CPC ..... *F01P 7/16* (2013.01); *F01P 3/02* (2013.01); *F01P 3/20* (2013.01); *F01P 7/14* (2013.01);
(Continued)

(58) Field of Classification Search
CPC ..... F01P 2007/146; F01P 2037/00; B60H 1/00885
(Continued)

(56) References Cited

U.S. PATENT DOCUMENTS 6,662,790 B1 12/2003 Kawamura et al.
7,168,397 B2 1/2007 Chanfreau et al.
(Continued)

FOREIGN PATENT DOCUMENTS

EP 1 702 149 B1 9/2006
JP 2003-21246 1/2003
(Continued)

OTHER PUBLICATIONS

U.S. Appl. No. 16/293,737 to Sato filed Mar. 6, 2019 (25 pgs.).

*Primary Examiner* — Long T Tran
*Assistant Examiner* — James J Kim
(74) *Attorney, Agent, or Firm* — Nixon & Vanderhye P.C.

(57) ABSTRACT

A valve control device includes a valve unit disposed in a cooling water circuit, and a control part which controls operation of the valve unit. The control part has a rotation angle instruction part, a duty ratio calculator and a determiner. The rotation angle instruction part calculates an instruction value of a rotation angle in response to an operational status of an internal-combustion engine. The duty ratio calculator calculates a duty ratio representing a ratio of ON period to OFF period regarding a voltage applied to an electric motor based on a difference between a detection value of the rotation angle detected by a detector and the instruction value of the rotation angle, and regulates the duty ratio to be lower than or equal to a predetermined upper limit. The determiner determines whether the duty ratio continues to be the upper limit during a predetermined period.

12 Claims, 6 Drawing Sheets

(51) Int. Cl.

| | |
|---|---|
| ***F01P 11/14*** | (2006.01) |
| ***F01P 3/02*** | (2006.01) |
| ***F01P 3/20*** | (2006.01) |
| ***F01P 11/18*** | (2006.01) |

(52) U.S. Cl.
CPC ..... *F01P 11/14* (2013.01); *F01P 11/18* (2013.01); *F01P 2003/028* (2013.01); *F01P 2007/146* (2013.01); *F01P 2031/20* (2013.01); *F01P 2060/04* (2013.01); *F01P 2060/08* (2013.01)

(58) Field of Classification Search
USPC ..... 123/41.1
See application file for complete search history.

(56) References Cited

U.S. PATENT DOCUMENTS

| | | | | |
|---|---|---|---|---|
| 2005/0034688 | A1 | 2/2005 | Lelkes et al. | |
| 2008/0085431 | A1* | 4/2008 | Kohno ..... | H01M 8/04194 429/414 |
| 2015/0122359 | A1 | 5/2015 | Tsuchiya et al. | |
| 2015/0370261 | A1* | 12/2015 | Yokoyama ..... | F02D 41/1401 700/282 |
| 2016/0084143 | A1* | 3/2016 | Lee ..... | F01P 7/165 123/41.08 |
| 2016/0091942 | A1* | 3/2016 | Park ..... | G06F 1/3296 713/310 |
| 2016/0273671 | A1* | 9/2016 | Chang ..... | F01P 7/14 |
| 2016/0363036 | A1 | 12/2016 | Imasaka | |
| 2017/0016381 | A1* | 1/2017 | Yumisashi ..... | B60H 1/08 |
| 2017/0022881 | A1* | 1/2017 | Matsumoto ..... | F01P 7/16 |
| 2018/0149073 | A1 | 5/2018 | Shen et al. | |

FOREIGN PATENT DOCUMENTS

| | | |
|---|---|---|
| JP | 2003-314716 | 11/2003 |
| JP | 2006-125274 | 5/2006 |
| JP | 2009-299543 | 12/2009 |
| JP | 2012-229735 | 11/2012 |
| JP | 2014-001646 | 1/2014 |
| JP | 2014-142005 | 8/2014 |
| JP | 2014-169661 | 9/2014 |
| JP | 2015-59615 | 3/2015 |
| WO | 03/046342 A1 | 6/2003 |

* cited by examiner (a)

(b)

VALVE CONTROL DEVICE

CROSS REFERENCE TO RELATED APPLICATION

This application is the U.S. national phase of International Application No. PCT/JP2016/076082 filed Sep. 6, 2016, which designated the U.S. and claims priority to Japanese Patent Application No. 2015-205871 filed on Oct. 19, 2015, the entire contents of each of which are incorporated herein by reference.

TECHNICAL FIELD

The present disclosure relates to a valve control device for a cooling water circuit through which cooling water of an internal-combustion engine circulates, in particular, to a valve control device suitably used for a cooling water circuit through which cooling water circulates also for other apparatus other than an internal-combustion engine.

BACKGROUND ART

A valve control device is well-known, which has a valve unit disposed in a cooling water circuit of an internal-combustion engine and a control part. The valve unit is assembled in the cooling water circuit to increase or decrease the flow rate of the cooling water to the internal-combustion engine, and the control part controls operation of the valve unit. The valve unit has an electric motor to which voltage is applied by the control part, and a valve object driven to rotate by the output of the electric motor to increase or decrease the flow rate of the cooling water to the internal-combustion engine. In the cooling water circuit, cooling water circulates also to other apparatus (for example, heater core of an air-conditioner for a vehicle, and/or oil cooler for lubricating oil of the internal-combustion engine) other than the internal-combustion engine. The circulation of the cooling water to the other apparatus is started or stopped by a valve device other than the valve control device.

In recent years, the valve control device for circulation to the internal-combustion engine and the valve device for circulation to the other apparatus are put together in the cooling water circuit. Patent Literature 1 describes a configuration in which a valve unit of a valve control device is made to have functions starting and stopping the circulation of the cooling water to the other apparatus. Specifically, the housing of the valve object has ports corresponding to the internal-combustion engine and the other apparatus. In response to the rotation angle of the valve object, the flow rate of the cooling water to the internal-combustion engine is increased or decreased, and the circulation of the cooling water to the other apparatus is started and stopped.

However, if a foreign object enters the valve unit, a fault arises in rotation of the valve object. Then, the circulation state of cooling water will shift from a desired state both for the internal-combustion engine and the other apparatus. That is, a foreign object entering the valve unit, in Patent Literature 1, has large influence on both of the internal-combustion engine and the other apparatus. For this reason, it is required to detect a foreign object caught in the valve unit.

In order to detect a foreign object, an over-current detector which detects an over-current to an electric motor, and a torque detection part which detects a torque transmitted to a valve object are well-known (for example, refer to Patent Literatures 2, 3). In Patent Literature 2, a foreign object is detected when the over-current detector detects an over-current. In Patent Literature 3, a foreign object is detected when the torque detection part detects excessive torque. However, the necessity of adding the over-current detector and the torque detection part increases the size of the valve control device.

PRIOR ART LITERATURES

Patent Literature

Patent Literature 1: JP 2014-001646 A
Patent Literature 2: JP 2012-229735 A
Patent Literature 3: JP 2014-142005 A

SUMMARY OF INVENTION

It is an object of the present disclosure to provide a valve control device including a valve unit that circulates cooling water to an apparatus other than an internal-combustion engine, in which a foreign object caught in the valve unit can be detected, while an increase in the size can be restricted.

According to an aspect of the present disclosure, a valve control device is used for a cooling water circuit through which cooling water of an internal-combustion engine circulates also to other apparatus other than the internal-combustion engine and a radiator. The valve control device includes a valve unit and a control part. The valve unit is disposed in the cooling water circuit to increase or decrease a flow rate of cooling water to the internal-combustion engine, and to start or stop circulation of cooling water to the other apparatus. The control part controls operation of the valve unit.

The valve unit has an electric motor, a driven component and a detector. The electric motor is controlled by the control part in an application of a voltage to increase or decrease the output. The driven component has a rotor rotated by the output of the electric motor, and the rotor rotates to increase or decrease the flow rate of cooling water to the internal-combustion engine, and to start or stop the circulation of cooling water to the other apparatus. The detector detects a rotation angle of the rotor.

The control part has a rotation angle instruction part, a duty ratio calculator and a determiner. The rotation angle instruction part calculates an instruction value of the rotation angle in response to an operational status of the internal-combustion engine. The duty ratio calculator calculates a duty ratio representing a ratio of ON period to OFF period regarding the voltage applied to the electric motor based on a difference between the detection value of the rotation angle acquired from the detector and the instruction value of the rotation angle. The duty ratio calculator regulates the duty ratio to be lower than or equal to a predetermined upper limit. The determiner determines whether the duty ratio continues to be the upper limit during a predetermined period.

Thereby, a foreign object caught in the valve unit can be detected by monitoring the duty ratio, without using an over-current detector and a torque detection part. For this reason, in a valve control device equipped with the valve unit which circulates cooling water also to the other apparatus other than the internal-combustion engine and the radiator, a foreign object caught in the valve unit is detectable, while restricting the increase in the physique.

DESCRIPTION OF EMBODIMENTS

Hereafter, an embodiment is described. The embodiment discloses a concrete example, and the present disclosure is not limited to the embodiment.

Embodiment

Figure 1:
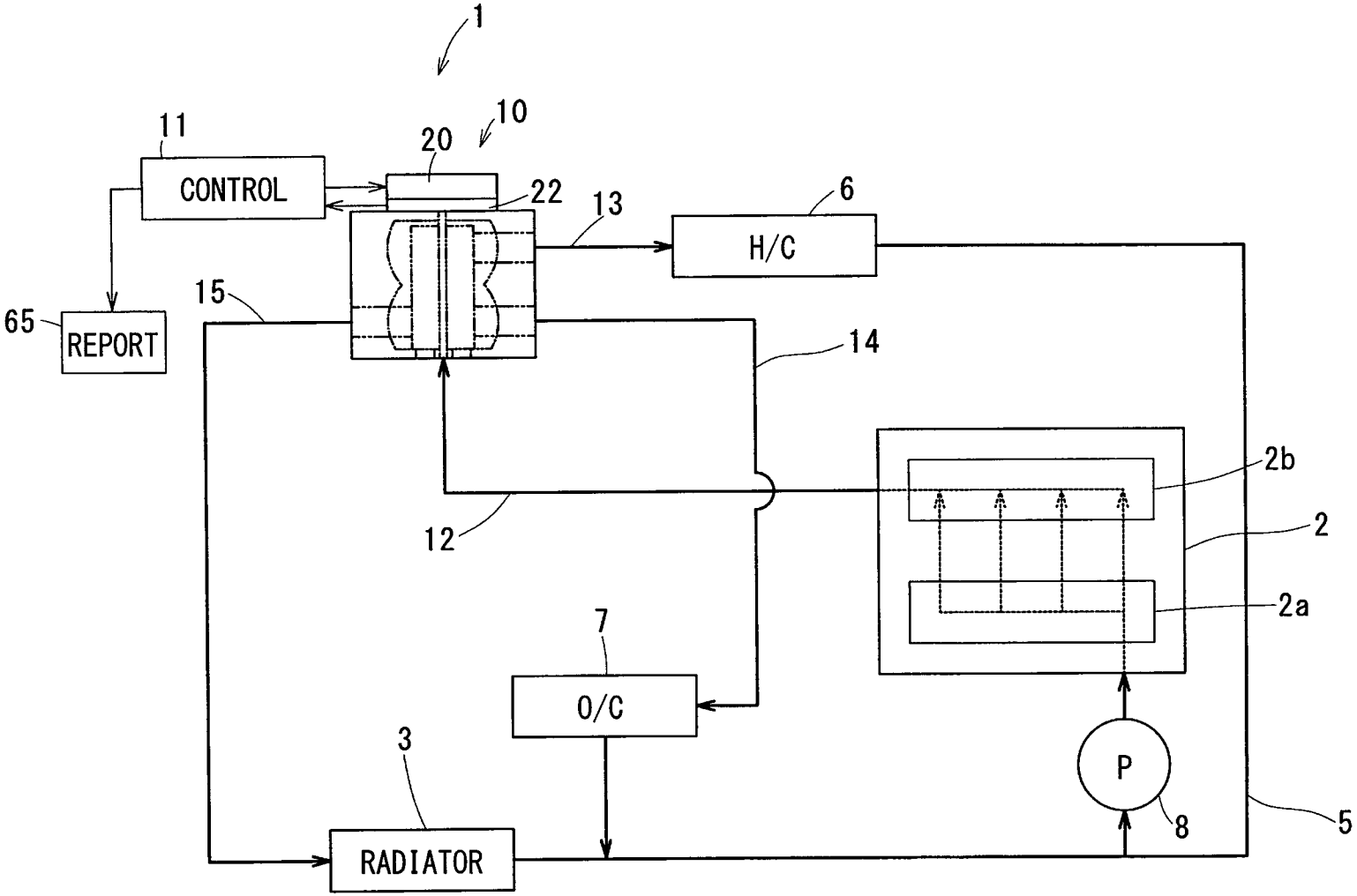
FIG. 1 is a diagram illustrating a cooling control device of an internal-combustion engine for a vehicle, in which a valve control device according to an embodiment is disposed.

A configuration of a cooling control device of an internal-combustion engine for a vehicle is explained based on FIG. 1, in which a valve control device 1 according to an embodiment is applied.

The valve control device 1 is used for a cooling-water circuit 5 through which cooling water of the internal-combustion engine 2 circulates to an apparatus other the internal-combustion engine 2 and a radiator 3. As the other apparatus, for example, a heater core (H/C) 6 and an oil cooler (O/C) 7 are arranged in the cooling-water circuit 5. Further, a pump 8 is arranged in the cooling-water circuit 5 as a source of power which circulates cooling water.

The pump 8 is, for example, an electric pump, and supplies cooling water to cool a cylinder block 2*a* and a cylinder head 2*b* of the internal-combustion engine 2 through the radiator 3. The pump 8 further circulates cooling water to the heater core 6 and the oil cooler 7. The radiator 3 is a heat exchanger for cooling the cooling water. The heater core 6 is a heat exchanger for heating the vehicle interior using the cooling water as a heat source. The oil cooler 7 is a heat exchanger in which heat is exchanged with lubricating oil of the internal-combustion engine 2 using the cooling water as a media. The cooling water is pumped from the pump 8 to pass through the internal-combustion engine 2 and to flow into the valve control device 1. The cooling water circulates through the cooling-water circuit 5 from the valve control device 1 through one or some of the heater core 6, the oil cooler 7, and the radiator 3 to return the pump 8.

The valve control device 1 includes a valve unit 10 and a control part 11 which are explained below. The valve unit 10 is arranged in the cooling-water circuit 5 to increase or decrease the flow rate of cooling water to the internal-combustion engine 2 and the radiator 3 and to start or stop circulation of the cooling water to the heater core 6 and the oil cooler 7. The control part 11 controls operation of the valve unit 10.

The valve unit 10 is connected to the internal-combustion engine 2 through a channel 12, connected to the heater core 6 through a channel 13, connected to the oil cooler 7 through a channel 14, and connected to the radiator 3 through a channel 15. The channel 12 leads cooling water to the valve unit 10 from the internal-combustion engine 2. The channel 13 leads cooling water to the heater core 6 from the valve unit 10. The channel 14 leads cooling water to the oil cooler 7 from the valve unit 10. The channel 15 leads cooling water to the radiator 3 from the valve unit 10.

Figure 2:
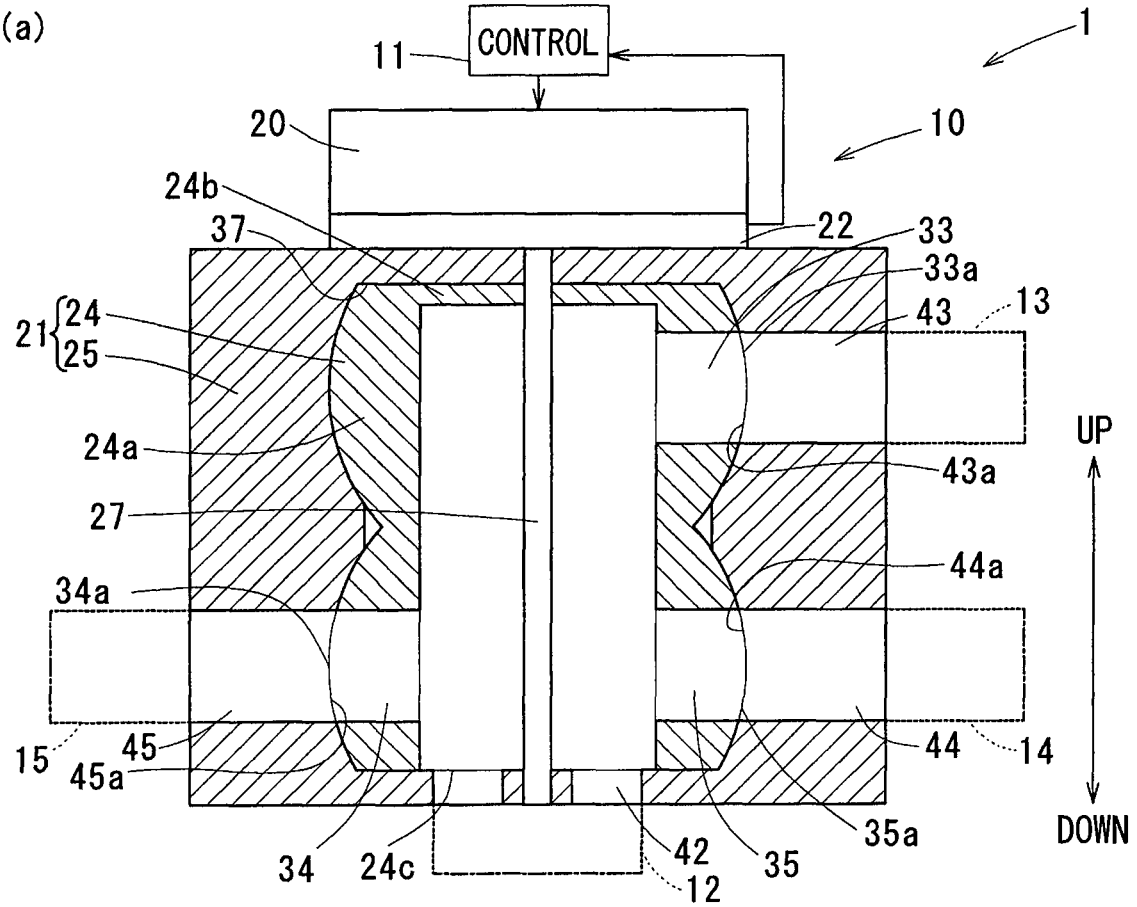
FIG. 2 includes (a) a longitudinal sectional view illustrating a valve unit of the embodiment, and (b) a side view illustrating a valve object of the embodiment.
Figure 2:
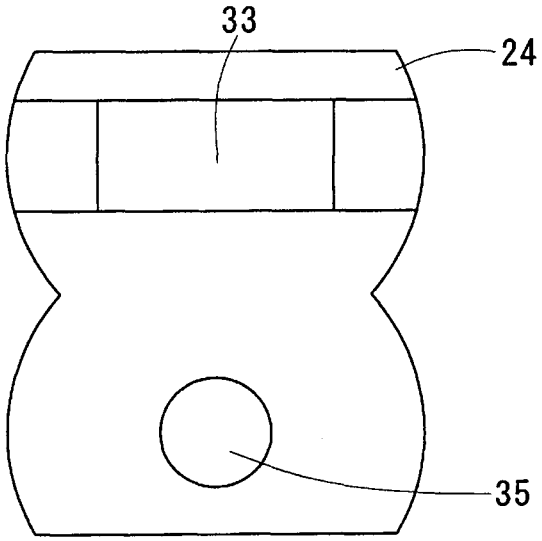

The valve unit 10 is explained with reference to FIG. 2. In explanation of FIG. 2, an upper side in the illustration may be called as "up" and a lower side in the illustration may be called as "down."

The valve unit 10 has an electric motor 20, a rotary valve (RN) 21 which is a driven component, and a detector 22 to be explained below. The voltage applied to the electric motor 20 is controlled by the control part 11, to increase or decrease the output of the electric motor 20. The electric motor 20 is, for example, a direct-current motor, and a duty ratio DR representing a ratio of ON period to OFF period regarding the voltage applied to the armature coil is controlled. The electric motor 20 is able to rotate in a right direction and a reverse direction by operating switching of an H bridged circuit 23 which is a drive circuit driving the electric motor 20 (refer to FIG. 5). The electric motor 20 may directly drive the rotary valve 21, or may drive the rotary valve 21 after increasing the torque with a reduction gear.

The rotary valve 21 includes a valve object 24 which is a rotor rotated by the output of the electric motor 20. The rotary valve 21 increases or decreases the flow rate of the cooling water to the internal-combustion engine 2 and the radiator 3, and starts or stops circulation of the cooling water to the heater core 6 and the oil cooler 7, by rotation of the valve object 24.

The rotary valve 21 has the valve object 24 and a housing 25. The valve object 24 is a cylinder object in which the upper end is closed. Specifically, the valve object 24 has a cylinder part 24*a*, a blockade part 24*b*, and an axial part 27 driven to rotate. The axial part 27 is integrally connected with the blockade part 24*b*. The valve object 24 has an opening 24*c* at the lower end. The cylinder part 24*a* has valve holes 33-35 passing through in the radial direction, and the valve holes 33-35 are divided into two stages, that is, divided between the upper side and the lower side. The valve holes 34 and 35 are formed on the lower side, and are separated from each other in the circumferential direction. The valve hole 33 is formed on the upper side. The valve hole 33 is a penetration hole having a shape of a slit extending in the circumferential direction.

The housing 25 forms an outline of the rotary valve 21, and houses the valve object 24. The housing 25 has a valve object housing 37 shaped in a cylindrical hole for housing the valve object 24, a passage 42 which extends downward from the lower end of the valve object housing 37, and passages 43-45 extending in the radial direction of the valve object housing 37. The passages 42-45 communicate with the channels 12-15, respectively. Two of the passages 44 and 45 are formed on the lower side in the housing 25, and the passage 43 is formed on the upper side.

The passages 44 and 45 are formed so that an opening 44*a*, 45*a* at the inner circumference side of the passage 44, 45 and an opening 34*a*, 35*a* at the outer circumference side of the valve hole 34, 35 overlap with each other by rotation of the valve object 24. Similarly, the passage 43 is formed so that an opening 43*a* at the inner circumference side of the passage 43 and an opening 33*a* at the outer circumference side of the valve hole 33 overlap with each other by rotation of the valve object 24. Since the passage 42 and the interior space of the valve object 24 are communicated with each other through the opening 24*c*, the cooling water is introduced inside the valve object 24. The detector 22 detects the rotation angle of the valve object 24. The detector 22 is, for example, a non-contact-type position sensor.

The control part 11 is, for example, an electronic control unit (ECU) which controls the internal-combustion engine 2. A signal is inputted into the control part 11 from various sensors mounted in the vehicle to detect parameters representing the operational status and the control state of the internal-combustion engine 2. Moreover, the control part 11 includes an input circuit processing the inputted signal, CPU which performs a control processing and a calculation processing regarding the control of the internal-combustion engine 2 based on the inputted signal, various kinds of memories which memorize and hold data, program, etc. required for control of the internal-combustion engine 2, and an output circuit which outputs a signal required for control of the internal-combustion engine 2 based on the processing result of CPU. In this embodiment, the control part 11 includes the H bridged circuit 23 which is a drive circuit driving the electric motor 20 (refer to FIG. 5).

Figure 5:
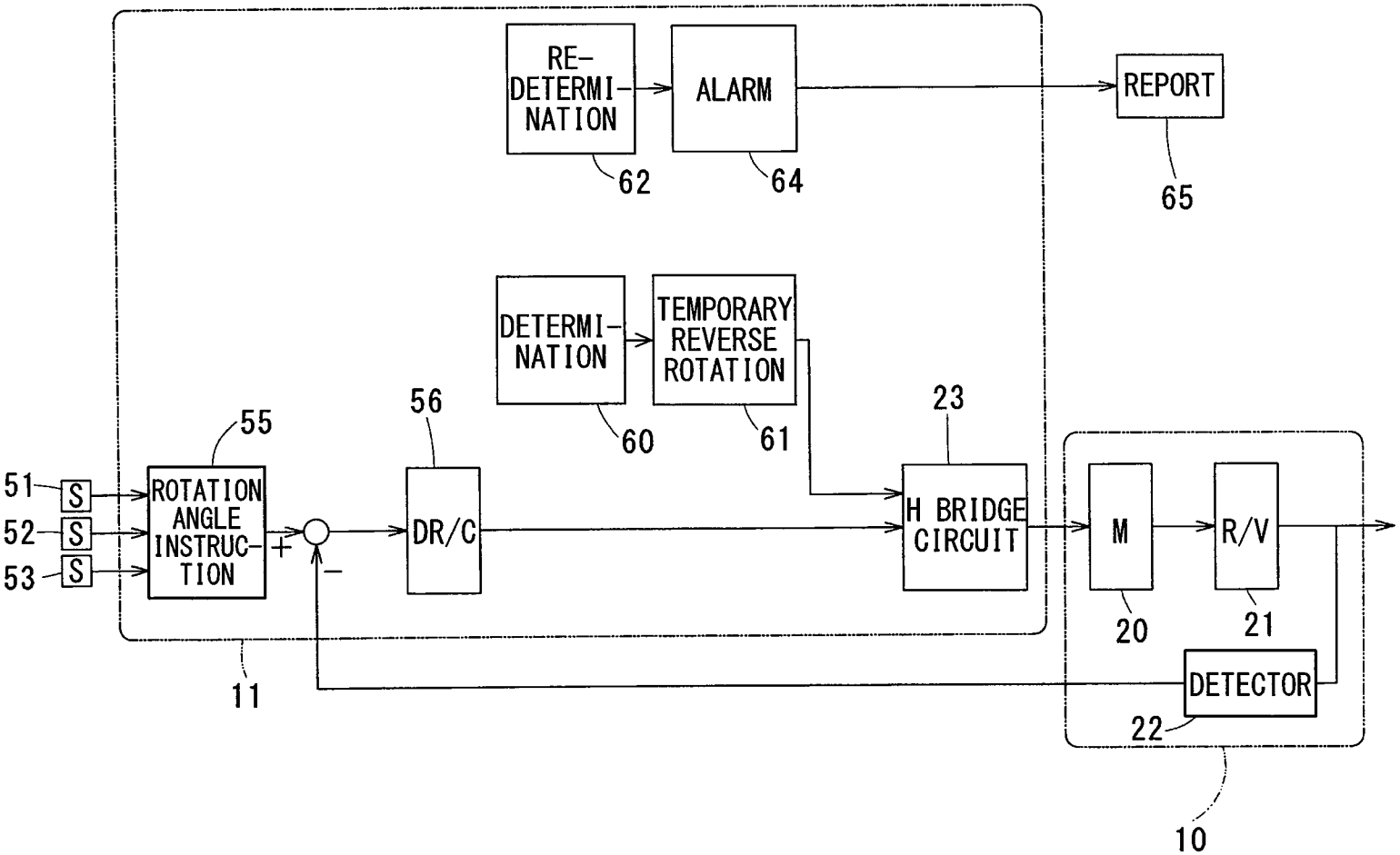
FIG. 5 is a control block diagram illustrating a control part of the embodiment.

The various sensors which output signals to the control part 11 include, for example, a rotation speed sensor 51 which detects the number of rotations in the internal-combustion engine 2, an intake pressure sensor 52 which detects the pressure of intake air drawn by the internal-combustion engine 2, and an air/fuel ratio sensor 53 which detects the air/fuel ratio of fuel-air mixture (refer to FIG. 5).

The control part 11 includes a rotation angle instruction part 55 and a duty ratio calculator (DR/C) 56.

The rotation angle instruction part 55 calculates an instruction value of the rotation angle in response to the operational status of the internal-combustion engine 2. That is, the rotation angle instruction part 55 calculates the instruction value of the rotation angle based on the inputted signals from the sensors 51-53 (refer to FIG. 5).

The duty ratio calculator 56 calculates the duty ratio DR representing a ratio of ON period to OFF period regarding the voltage applied to the electric motor 20 based on the difference between the detection value of the rotation angle acquired from the detector 22 and the instruction value of the rotation angle, and regulates the duty ratio DR to be lower than or equal to a predetermined upper limit UL.

More specifically, the duty ratio calculator 56 calculates the duty ratio DR using PID control in which the detection value of the rotation angle is fed back to reduce the difference between the detection value of the rotation angle and the instruction value of the rotation angle, and determines the duty ratio DR by comparing with the predetermined upper limit UL (refer to FIG. 5). In addition, the PID control may be replaced with PI control in which the differentiation is removed from the PID control.

When a signal corresponding to the determined duty ratio DR is inputted, ON/OFF of four switching elements in the H bridged circuit 23 is controlled, and voltage is impressed to the electric motor 20 with the determined duty ratio DR (refer to FIG. 5). The value of the determined duty ratio DR is lower than or equal to the predetermined upper limit UL.

Figure 3:
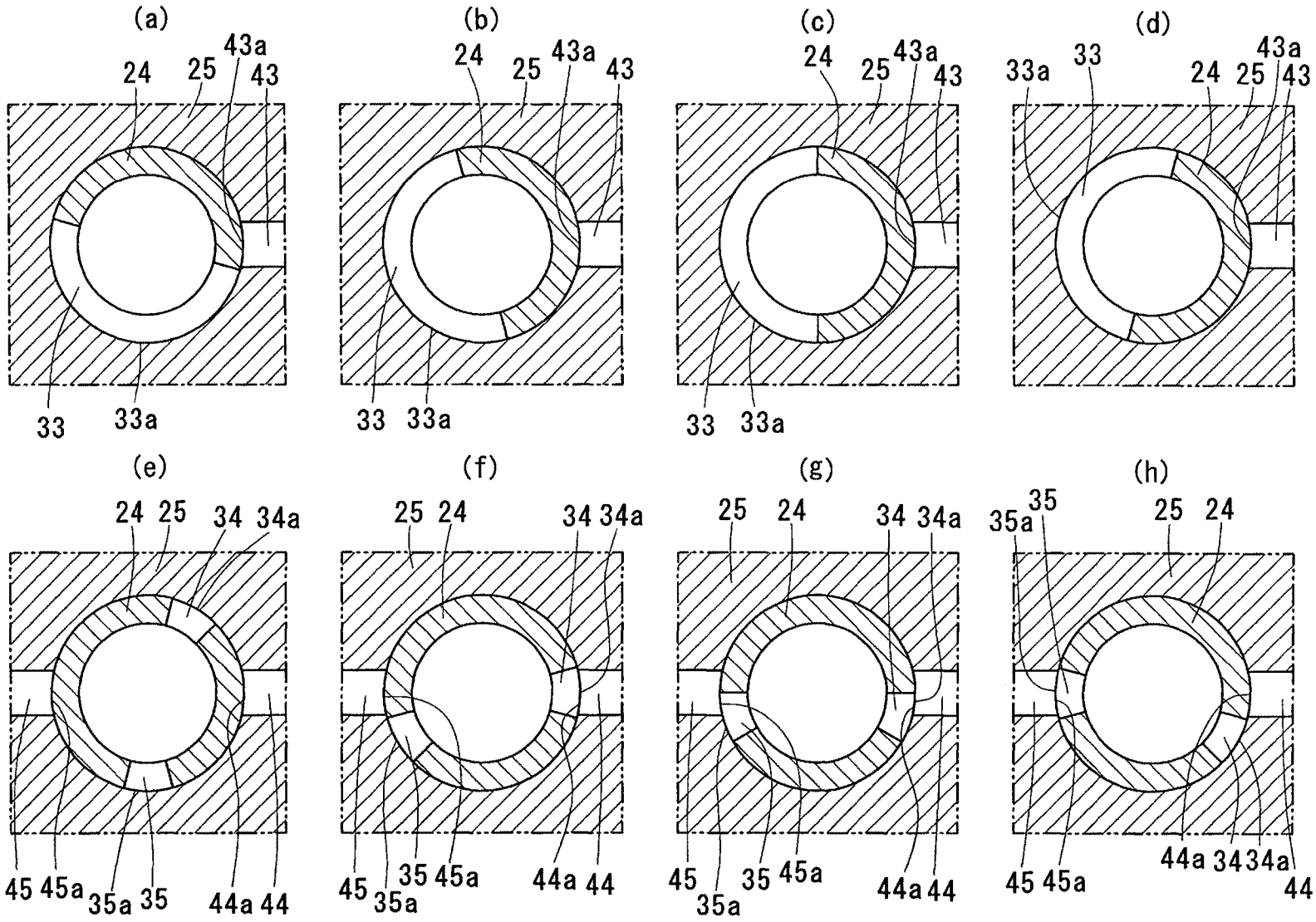
FIG. 3 is a diagram illustrating opening-and-closing operation of channels when rotating the valve object clockwise in a circumferential direction.
Figure 4:
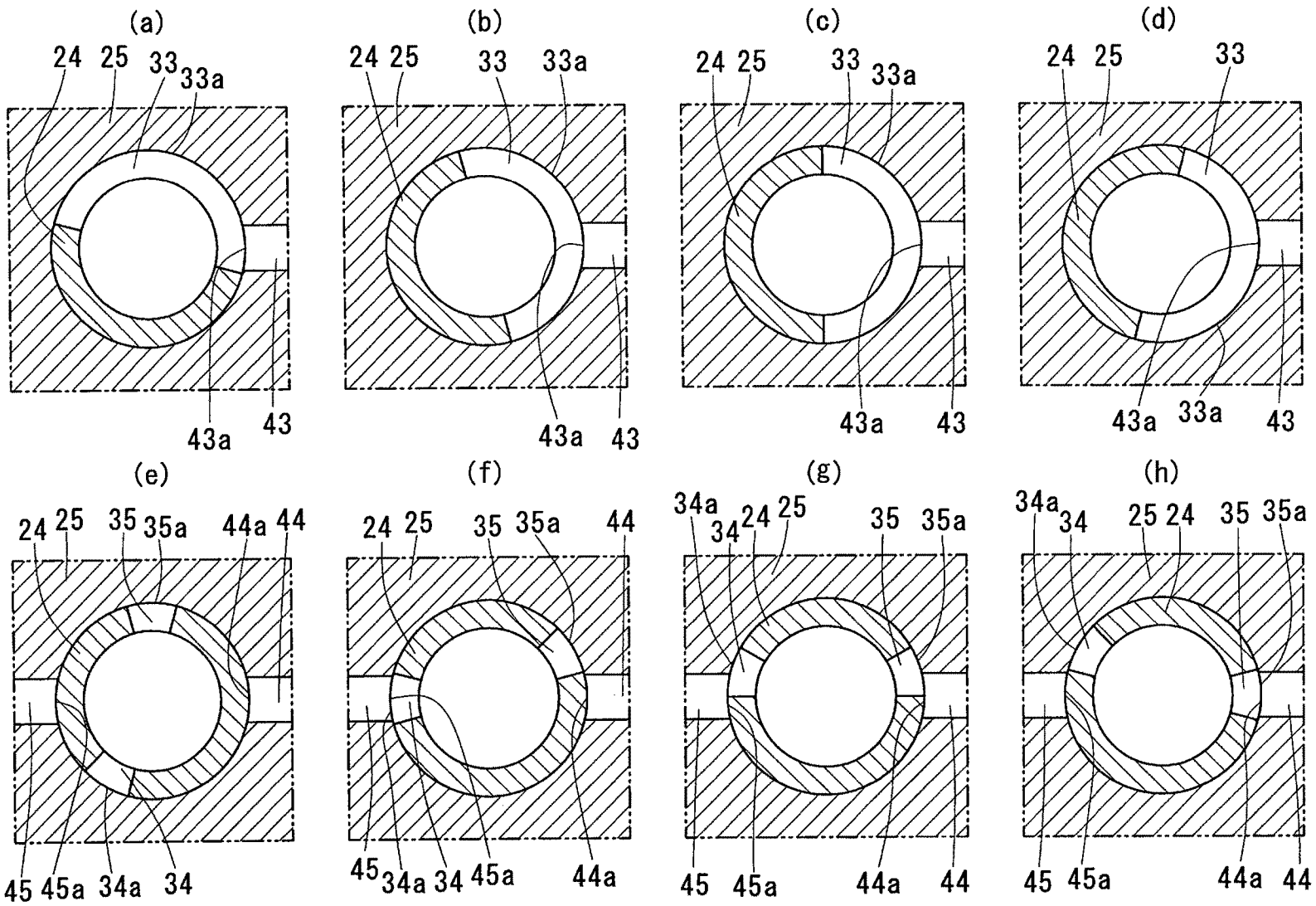
FIG. 4 is a diagram illustrating opening-and-closing operation of channels when further rotating the valve object clockwise in the circumferential direction.

The basic motion in the valve unit 10 is explained with reference to FIG. 3 and FIG. 4. (a)-(d) of FIG. 3 represent the opening-and-closing state of the upper channel in FIG. 2, and (e)-(h) of FIG. 3 represent the opening-and-closing state of the lower channel in FIG. 2. (a)-(d) of FIG. 4 represent the opening-and-closing state of the upper channel in FIG. 2, and (e)-(h) of FIG. 4 represent the opening-and-closing state of the lower channel in FIG. 2.

An overlap arises between the opening 34*a* and the opening 44*a* (refer to (b) and (f) of FIG. 3) by rotating the valve object 24 clockwise in the circumferential direction from the state (refer to (a) and (e) of FIG. 3) in which the openings 33*a*-35*a* and the openings 43*a*-45*a* do not overlap. Thereby, the passage 42 and the passage 44 communicate with each other, and supply of cooling water is started to the oil cooler 7 through the channel 14.

Furthermore, an overlap arises between the opening 35*a* and the opening 45*a* (refer to (c) and (g) of FIG. 3) by further rotating the valve object 24 clockwise in the circumferential direction, in the state where the overlap is maintained between the opening 34*a* and the opening 44*a*. Thereby, because the passage 42 and the passage 45 communicate with each other, cooling water is supplied to the internal-combustion engine 2 via the radiator 3 through the channel 15. In addition, the supply of the cooling water to the oil cooler 7 is also maintained, since the communicate state of the passage 42 and the passage 44 is maintained. The flow rate of the cooling water to the internal-combustion engine 2 and the radiator 3 can be increased or decreased by increasing or decreasing, for example, the amount of overlap between the opening 35*a* and the opening 45*a*.

Furthermore, the overlap between the opening 34*a* and the opening 44*a* is canceled (refer to (d) and (h) of FIG. 3) by further rotating the valve object 24 clockwise in the circumferential direction in the state where the overlap between the opening 35*a* and the opening 45*a* is maintained. Thereby, cooling water is supplied only to the radiator 3.

Furthermore, the overlap between the opening 35*a* and the opening 45*a* is canceled, and an overlap is generated between the opening 33*a* and the opening 43*a* (refer to (a) and (e) of FIG. 4) by further rotating the valve object 24 clockwise in the circumferential direction. Thereby, the passage 42 and the passage 43 communicate with each other, and supply of cooling water is started to the heater core 6 through the channel 13.

Furthermore, an overlap between the opening 34*a* and the opening 45*a* arises (refer to (b) and (f) of FIG. 4) in the state where the overlap between the opening 33*a* and the opening 43*a* is maintained, by further rotating the valve object 24 clockwise in the circumferential direction. Thereby, cooling water is supplied to the heater core 6 and the radiator 3.

Furthermore, an overlap between the opening 35*a* and the opening 44*a* arises (refer to (c) and (g) of FIG. 4) in the state where the overlap between the opening 33*a* and the opening 43*a*, and the overlap between the opening 34*a* and the opening 45*a* are maintained, by further rotating the valve object 24 clockwise in the circumferential direction. Thereby, cooling water is supplied to the heater core 6, the radiator 3, and the oil cooler 7.

The overlap between the opening 34*a* and the opening 45*a* is canceled in the state where the overlap between the opening 33*a* and the opening 43*a* and the overlap between the opening 35*a* and the opening 44*a* are maintained by further rotating the valve object 24 clockwise in the circumferential direction. Thereby, cooling water is supplied to the heater core 6 and the oil cooler 7 (refer to (d) and (h) of FIG. 4).

Thus, the valve unit 10 can increase or decrease the flow rate of the cooling water to the internal-combustion engine 2 and the radiator 3, and can start or stop the circulation of the cooling water to the heater core 6 and the oil cooler 7. Although the valve object 24 is rotated clockwise in the circumferential direction, it is possible to rotate counter-clockwise in the circumferential direction by reversing the electric motor 20.

As shown in FIG. 5, the control part 11 further includes a determiner 60, a temporarily reversing part 61, a re-determining part 62, and an alarming part 64 in addition to the rotation angle instruction part 55 and the duty ratio calculator 56, in the valve control device 1.

The determiner 60 determines whether the duty ratio DR determined by the duty ratio calculator 56 continues to be the upper limit UL during a predetermined period.

The temporarily reversing part 61 temporarily rotates the electric motor 20 in the reverse direction, when the determiner 60 determines that the determined duty ratio DR continues to be the upper limit UL during the predetermined period.

At this time, the temporarily reversing part 61 temporarily rotates the electric motor 20 in the reverse direction by carrying out on/off control of the H bridged circuit 23 with a predetermined duty ratio for the reverse rotation, without calculating a duty ratio by the duty ratio calculator 56. After reversing the electric motor 20 temporarily, the duty ratio calculator 56 returns to determine the duty ratio DR.

The re-determining part 62 determines whether the duty ratio DR continues to be the upper limit UL, after temporarily rotating the electric motor 20 in the reverse direction by the reversing part 61. At this time, the re-determining part 62 determines whether the duty ratio DR determined by the duty ratio calculator 56 continues to be the upper limit UL again during a predetermined period.

The alarming part 64 outputs a signal which actuates the report part 65, when the re-determining part 62 determines that the duty ratio DR continues to be the upper limit UL. A vehicle in which the internal-combustion engine 2 is mounted has the report part 65 which reports the abnormality of the internal-combustion engine 2 to an occupant of the vehicle. The report part 65 is, for example, an alarm light which tells an abnormal condition or an alarm sound generator which tells an abnormal condition.

Figure 6:
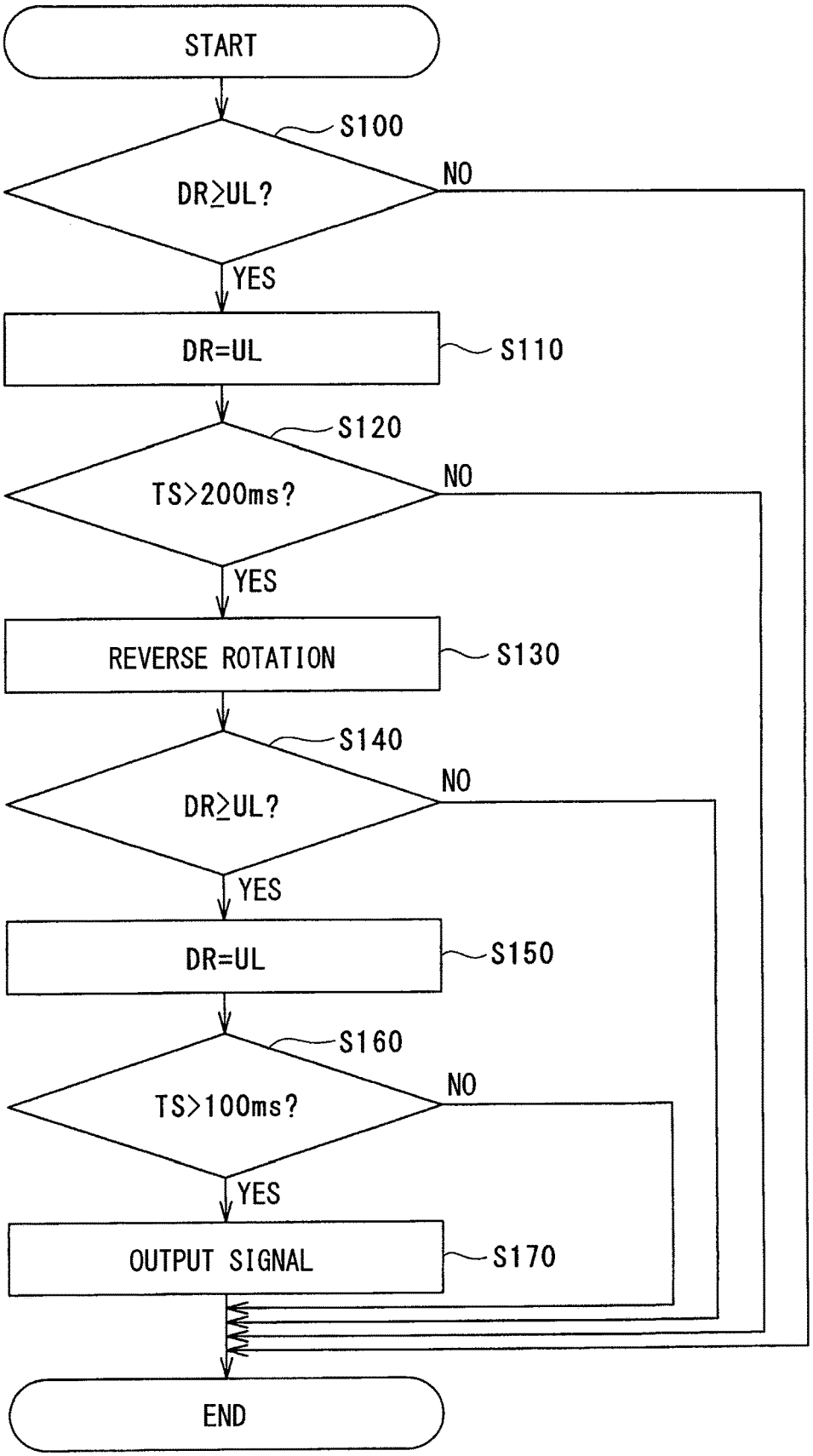
FIG. 6 is a flow chart showing a control method when a foreign object is caught by the valve object.

The control method is explained with reference to the flow chart of FIG. 6 when a foreign object is caught by the valve object 24 of the embodiment.

In S100, the duty ratio DR is calculated based on PID control, and it is determined whether the computed duty ratio DR is more than or equal to the upper limit UL. When it is determined that the computed duty ratio DR is more than or equal to the upper limit UL (YES), the control part proceeds to S110. When it is determined that the duty ratio DR does not exceed the upper limit UL (NO), the processing is ended.

Next, the duty ratio DR is set as the upper limit UL in S110, and the control part proceeds to S120. S100 and S110 correspond to the duty ratio calculator 56.

In S120, it is determined whether a period TS during which the duty ratio is the upper limit UL continues over 200 ms. The period TS corresponds to a predetermined period which is a value set in advance, but is not restrained to this value (200 ms). When it is determined that the period TS during which the duty ratio is the upper limit UL continues over 200 ms (YES), the control part proceeds to S130. When it is determined that the period TS during which the duty ratio is the upper limit UL does not continue over 200 ms (NO), the processing is ended. S120 corresponds to the determiner 60.

Next, the electric motor 20 is temporarily rotated in the reverse direction in S130 to reverse-rotate the valve object 24, and the control part proceeds to S140. At this time, the electric motor 20 is rotated in the reverse direction with the reverse-rotation duty ratio set in advance, without calculating the duty ratio by the duty ratio calculator 56. S130 corresponds to the temporarily reversing part 61.

Next, in S140, again, the duty ratio DR is calculated based on PID control, and it is determined whether the computed duty ratio DR is more than or equal to the upper limit UL. When it is determined that the computed duty ratio DR is more than or equal to the upper limit UL (YES), the control part proceeds to S150. When it is determined that the computed duty ratio DR does not exceed the upper limit UL (NO), the processing is ended. Then, in S150, the duty ratio DR is set to the upper limit UL, and the control part proceeds to S160. S140 and S150 correspond to the duty ratio calculator 56.

Next, in S160, it is determined whether the period TS during which the duty ratio is the upper limit UL continues over 100 ms. The period TS corresponds to a predetermined period which is a value set beforehand, but is not restrained to this value (100 ms). When it is determined that the period TS during which the duty ratio is the upper limit UL continues over 100 ms (YES), the control part proceeds to S170. When it is determined that the period TS during which the duty ratio is the upper limit UL does not continue over 100 ms (NO), the processing is ended. S160 corresponds to the re-determining part 62. Then, in S170, a signal which actuates the report part 65 is outputted and the processing is ended. S170 corresponds to the alarming part 64.

According to the valve control device 1 of the embodiment, the control part 11 has the rotation angle instruction part 55, the duty ratio calculator 56, and the determiner 60. The rotation angle instruction part 55 calculates the instruction value of the rotation angle according to the operational status of the internal-combustion engine 2. The duty ratio calculator 56 calculates the duty ratio DR representing a ratio of the ON period to the OFF period regarding the voltage applied to the electric motor 20 based on the difference between the detection value of the rotation angle acquired from the detector 22 and the instruction value of the rotation angle, and regulates the duty ratio DR to be lower than or equal to the predetermined upper limit UL. The determiner 60 determines whether the duty ratio DR is maintained to the upper limit UL during the predetermined period.

Thereby, a foreign object caught in the valve unit 10 can be detected by monitoring the duty ratio DR, without using an over-current detector and a torque detection part. For this reason, in the valve control device 1 equipped with the valve unit 10 which circulates the cooling water to the heater cores 6 and the oil cooler 7 other than the internal-combustion engine 2 and the radiator 3, a foreign object caught in the valve unit 10 is detectable, while controlling the increase in the physique.

Moreover, according to the valve control device 1 of the embodiment, the control part 11 has the temporarily reversing part 61 temporarily rotating the electric motor 20 in the reverse direction, when the determiner 60 determines that the duty ratio DR continues to be the upper limit UL during the predetermined period. The foreign object caught on the valve object 24 is easily removable by temporarily rotating the valve object 24 in the reverse direction.

Moreover, according to the valve control device 1 of the embodiment, the control part 11 has the re-determining part 62 which determines whether the duty ratio DR continues to be the upper limit UL, even after rotating the electric motor 20 in the reverse direction temporarily by the temporarily reversing part 61. The control part 11 has the alarming part 64 which outputs the signal which operates the report part 65, when it is determined that the duty ratio DR continues to be the upper limit UL by the re-determining part 62.

Thereby, after the control part 11 rotates the valve object 24 in the reverse direction temporarily by the temporarily reversing part 61 to remove the foreign object, a further determination is made by the re-determining part 62, and the control part 11 outputs the signal which operates the report part 65. For this reason, when the foreign object can be removed from the valve object 24 by temporarily reverse-rotating by the temporarily reversing part 61, the signal which operates the report part 65 is not outputted. Thus, the frequency operating the report part 65 can be reduced, and the frequency can be reduced for an occupant to receive the report from the report part 65.

[Modification]

The present disclosure can be implemented with various modifications in a range not deviated from the scope of the present disclosure.

In the embodiment, although the rotary valve 21 is a driven component driven by the electric motor 20, the driven component is not limited to the rotary valve.

For example, a butterfly valve which opens and closes a different passage may be linked with the valve object 24 of the rotary valve 21 through a gear. That is, the driven component driven by the electric motor 20 may be a structure which has the valve object 24 as a rotor and the butterfly valve.

The invention claimed is:

1. A valve control device for a cooling water circuit through which cooling water of an internal-combustion engine circulates also to other apparatus other than the internal-combustion engine and a radiator, the valve control device comprising:

a valve unit disposed in the cooling water circuit to increase or decrease a flow rate of cooling water to the internal-combustion engine and to start or stop circulation of cooling water to the other apparatus; and a control part which controls operation of the valve unit, wherein the valve unit has an electric motor controlled by the control part in an application of a voltage to increase or decrease an output, a driven component having a rotor rotated by the output of the electric motor, the rotor rotating to increase or decrease the flow rate of cooling water to the internal-combustion engine and to start or stop the circulation of cooling water to the other apparatus, and a detector which detects a rotation angle of the rotor, the control part has a rotation angle instruction part which calculates an instruction value of the rotation angle in response to an operational status of the internal-combustion engine, a duty ratio calculator which calculates a duty ratio representing a ratio of ON period to OFF period regarding the voltage applied to the electric motor based on a difference between a detection value of the rotation angle detected by the detector and the instruction value of the rotation angle, the duty ratio calculator regulating the duty ratio to be lower than or equal to a predetermined upper limit, and a determiner which determines whether the duty ratio continues to be the upper limit during a predetermined period.

2. The valve control device according to claim 1, wherein the control part has a temporarily reversing part which temporarily rotates the electric motor in a reverse direction, when the determiner determines that the duty ratio continues to be the upper limit during the predetermined period.

3. The valve control device according to claim 2, wherein the internal-combustion engine is mounted in a vehicle including a report part which reports an abnormality of the internal-combustion engine to an occupant of the vehicle, and the control part has a re-determining part which determines whether the duty ratio continues to be the upper limit after the electric motor is temporarily rotated in the reverse direction by the temporarily reversing part, and an alarming part which outputs a signal actuating the report part when the re-determining part determines that the duty ratio continues to be the upper limit.

4. The valve control device according to claim 1, wherein the determiner is configured to detect a foreign object caught in the valve unit by monitoring only the duty ratio.

5. The valve control device according to claim 1, wherein the determiner is configured to detect a foreign object caught in the valve unit by monitoring the duty ratio, without using an over-current detector and a torque detector.

6. The valve control device according to claim 1, wherein the determiner is configured to detect a foreign object caught in the valve unit by determining that the duty ratio continues to be the upper limit during the predetermined period; and the control part has a temporarily reversing part which temporarily rotates the electric motor in a reverse direction, when the determiner determines that the duty ratio continues to be the upper limit during the predetermined period, to remove the foreign object caught in the valve unit.

7. A valve control device for a cooling water circuit through which cooling water of an internal-combustion engine circulates also to other apparatus other than the internal-combustion engine and a radiator, the valve control device comprising:

a valve unit, disposed in the cooling water circuit, configured to increase or decrease a flow rate of cooling water to the internal-combustion engine and to start or stop circulation of cooling water to the other apparatus; and a controller, including a processor, for controlling operation of the valve unit, wherein the valve unit comprises:

an electric motor controlled by the controller in an application of a voltage to increase or decrease an output, a driven component having a rotor rotated by the output of the electric motor, the rotor rotating to increase or decrease the flow rate of cooling water to the internal-combustion engine and to start or stop the circulation of cooling water to the other apparatus, and a detector which detects a rotation angle of the rotor, the controller is configured at least to:

calculate an instruction value of the rotation angle in response to an operational status of the internal-combustion engine, calculate a duty ratio representing a ratio of ON period to OFF period regarding the voltage applied to the electric motor based on a difference between a detection value of the rotation angle detected by the detector and the instruction value of the rotation angle, regulate the duty ratio to be lower than or equal to a predetermined upper limit, and determine whether the duty ratio continues to be the upper limit during a predetermined period.

8. The valve control device according to claim 7, wherein the controller is further configured to temporarily rotate the electric motor in a reverse direction, when a determination is made that the duty ratio continues to be the upper limit during the predetermined period.

9. The valve control device according to claim 8, wherein the controller is further configured to:

determine whether the duty ratio continues to be the upper limit after the electric motor is temporarily rotated in the reverse direction by the controller, and outputting an alarm when a determination is made that the duty ratio continues to be the upper limit.

10. The valve control device according to claim 7, wherein the controller is further configured to detect a foreign object caught in the valve unit by monitoring only the duty ratio.

11. The valve control device according to claim 7, wherein the controller is further configured to detect a foreign object caught in the valve unit by monitoring the duty ratio, without using an over-current detector and a torque detector.

12. The valve control device according to claim 7, wherein the controller is further configured to:

detect that a foreign object is caught in the valve unit by determining that the duty ratio continues to be the upper limit during the predetermined period; and temporarily rotate the electric motor in a reverse direction, when a determination is made that the duty ratio continues to be the upper limit during the predetermined period, to remove the foreign object caught in the valve unit.

* * * * *